US008142108B2

(12) United States Patent
Pollack et al.

(10) Patent No.: US 8,142,108 B2
(45) Date of Patent: Mar. 27, 2012

(54) RISER INSTALLATION METHOD FROM AN OFFSHORE PRODUCTION UNIT

(75) Inventors: Jack Pollack, Monte Carlo (MC); Hein Wille, Eze (FR)

(73) Assignee: Single Buoy Moorings Inc., Marly (CH)

( * ) Notice: Subject to any disclaimer, the term of this patent is extended or adjusted under 35 U.S.C. 154(b) by 388 days.

(21) Appl. No.: 11/922,805

(22) PCT Filed: Jun. 29, 2006

(86) PCT No.: PCT/NL2006/050154

§ 371 (c)(1),
(2), (4) Date: Nov. 20, 2009

(87) PCT Pub. No.: WO2007/004875

PCT Pub. Date: Jan. 11, 2007

(65) Prior Publication Data

US 2010/0104373 A1 Apr. 29, 2010

(30) Foreign Application Priority Data

Jun. 30, 2005 (EP) ..... 05105983

(51) Int. Cl.
*E21B 43/01* (2006.01)

(52) U.S. Cl. ..... 405/169; 405/171; 405/224.2; 166/367

(58) Field of Classification Search ..... 405/169, 405/170, 172, 173, 223.1, 224, 224.2, 224.3, 405/224.4; 166/350, 367
See application file for complete search history.

(56) References Cited

U.S. PATENT DOCUMENTS

| | | | | |
|---|---|---|---|---|
| 3,331,212 | A | 7/1967 | Cox et al. | |
| 3,517,520 | A * | 6/1970 | Hammett | 405/169 |
| 3,955,599 | A | 5/1976 | Walker | |
| 4,182,584 | A | 1/1980 | Panicker et al. | |
| 4,266,886 | A * | 5/1981 | Milton | 405/169 |

(Continued)

FOREIGN PATENT DOCUMENTS

FR 2847245 A1 5/2004

(Continued)

OTHER PUBLICATIONS

Loic Des Deserts—Doris Engineering, "Hybrid Riser for Deepwater Offshore Africa", OTC 11875, Offshore Technology Conference, Houston, TX, May 1-4, 2000.

*Primary Examiner* — Frederic L Lagman
(74) *Attorney, Agent, or Firm* — The Webb Law Firm

(57) ABSTRACT

A riser installation method including the steps of providing a first vessel situated over a hydrocarbon well, supporting a hydrocarbon transfer duct from the first vessel by a first end that is attached to a lowering device on the first vessel, and attaching a second end of the hydrocarbon duct to a second vessel, at a position near the first vessel. The method also includes the steps of lowering the transfer duct, increasing the distance of the second vessel from the first vessel, pulling the transfer duct until the second vessel is near the third vessel, contacting a section of the transfer duct with the sea bed, displacing the second end of the transfer duct from the first vessel, returning the second end of the transfer duct to the mooring position, and bringing the second end of the hydrocarbon transfer duct in fluid communication with the third vessel.

17 Claims, 6 Drawing Sheets

U.S. PATENT DOCUMENTS

| | | | | |
|---|---|---|---|---|
| 4,687,377 | A * | 8/1987 | Langner | 405/169 |
| 4,704,050 | A * | 11/1987 | Wallace | 405/224.2 |
| 4,793,737 | A * | 12/1988 | Shotbolt | 405/169 |
| 5,437,518 | A * | 8/1995 | Maloberti et al. | 405/169 |
| 5,480,264 | A * | 1/1996 | Hunter | 405/169 |
| 5,615,977 | A * | 4/1997 | Moses et al. | 405/169 |
| 5,639,187 | A * | 6/1997 | Mungall et al. | 405/169 |
| 6,047,781 | A | 4/2000 | Scott et al. | |
| 6,068,069 | A | 5/2000 | Scott et al. | |
| 6,257,801 | B1 * | 7/2001 | Kelm et al. | 405/224.2 |
| 7,600,569 | B2 * | 10/2009 | Routeau et al. | 166/367 |
| 2001/0033773 | A1 | 10/2001 | Baugh | |
| 2003/0091396 | A1 | 5/2003 | Barras et al. | |
| 2006/0048850 | A1 | 3/2006 | Espinasse | |
| 2006/0140726 | A1 | 6/2006 | Pollack et al. | |
| 2008/0112763 | A1 * | 5/2008 | Pollack et al. | 405/170 |

FOREIGN PATENT DOCUMENTS

| | | |
|---|---|---|
| WO | 2004035375 A1 | 4/2004 |

* cited by examiner

RISER INSTALLATION METHOD FROM AN OFFSHORE PRODUCTION UNIT

CROSS REFERENCE TO RELATED APPLICATIONS

This application claims the benefit of International Application No. PCT/NL2006/050154, filed Jun. 29, 2006, which claims priority to EP 20050105983, filed Jun. 30, 2005, (now EP 1739279) the entire contents of each of the above are incorporated herein by reference.

BACKGROUND OF THE INVENTION

1) Field of the Invention

The invention relates to a riser installation method wherein a riser is lowered from a first vessel, and is towed with its termination end by a tug over the sea bed to a termination point.

2) Description of Related Art

Such an installation method is known from WO 2004/035375 in the name of the applicant. This publication describes a Floating Production Unit (FPU) that is anchored to the seabed and that comprises one or more risers extending from the vessel to the seabed. The FPU comprises lifting means for assembling and lowering risers vertically towards the seabed. The lowered risers can be pulled out from the FPU by a tug boat towards a pre-drilled wellhead and be connected to it so that hydrocarbons can flow from the wellhead to the FPU were the hydrocarbons can be processed and/or stored temporarily.

Another installation method connects different segments of a pipeline on shore and tows the pipeline to the place where it is installed on the seabed. From Offshore Technology Conference OTC 11875, Houston, Tex., 1-4 May 2000 with the title "Hybrid Riser for Deepwater Offshore Africa", a riser pipe for deep waters is described comprising a steel outer casing with a number of production risers, gas and water injection lines. The riser pipe is assembled on shore and towed to location where it is up righted and connected to the foundation on the seabed. The upper part of the riser is connected to a submerged buoy. After installation of the hybrid riser pipe, the submerged buoy is connected via flexible jumpers to the surface facility such as an FPSO, which may be located at a distance between 70 m-200 m from the submerged buoy. The known method has the disadvantage that during installation of the risers all at once, no hydrocarbon production and/or processing can take place. Furthermore, installation requires special and dedicated installation equipment. Specialised installation vessels are designed to work in as large as possible sea states and are hence, sizeable and costly equipment.

From U.S. Pat. No. 4,182,584 it is known to attach a free-standing marine production riser for use in deepwater between a base portion and a submerged buoy. With a derrick-equipped vessel, such as a semi-sub, the riser casing is lowered through the central part of the buoy and coupled to the bottom until the rigid riser part is completed. Next, a flexible hose is attached to a surface facility for hydrocarbon production and processing. Again, the use of separate, purpose build vessels for riser installation and for hydrocarbon production/processing requires scheduling and mobilising the installation vessel to site at large day rates and the demobilisation of the installation vessel after installation of the riser.

A deepwater field development may consist of several sub sea wells separated by long distances from a centralized FPU. These wells are tied back to the FPU via steel pipelines, and the risers may terminate on the production unit as SCRs. A large field scenario may take years to fully develop. Depending on drilling and completion schedules, construction vessels may be mobilized multiple times in order to connect the wells to the FPU. These vessels can cost millions of dollars to mobilize, and their working rates may exceed one or two hundred thousand dollars per day. It is therefore advantageous to minimize or eliminate the need for these vessels by self-installing the pipelines and risers from the drilling rig vessel.

The method of WO 2004/035375 describes a pipeline installation method without the use of a special pipe lay vessel, the termination part of the pipeline being installed on the sea bed or on a submerged buoy. When attaching the pipeline to a surface vessel, such as a FSU, the departure angle relative to the vertical should be accurately determined to prevent fatigue weakening during use, and should be for instance between 10° and 20°.

SUMMARY OF THE INVENTION

It is an object of the present invention to provide an installation method, which avoids the use of dedicated pipe-lay vessels and with which the departure angle of the risers attached to a surface vessel or to a submerged buoy can be accurately controlled.

Hereto the installation method according to the present invention comprises by the steps of:

a. providing a first vessel situated over a hydrocarbon well, b. supporting a hydrocarbon transfer duct from the first vessel by a first end that is attached to a lowering device on the first vessel, c. attaching a second end of the hydrocarbon duct to a second vessel, at a position near the first vessel, d. lowering the transfer duct via the lowering device, e. increasing the distance of the second vessel from the first vessel by sailing the second vessel in the direction of a third vessel, which is moored in a mooring position at a distance from the first vessel, while pulling the transfer duct until the second vessel is near the third vessel, f. contacting a section of the transfer duct with the sea bed at a position between the first and second ends of the transfer duct, g. displacing the second end of the transfer duct over a distance from the first vessel, seen in the length direction of the transfer duct, which is larger than the distance between the first vessel and the mooring position of the third vessel, h. returning the second end of transfer duct to the mooring position of the third vessel, and f bringing the second end of the hydrocarbon transfer duct in fluid communication with the third vessel.

By pulling the pipe-string, which may be a Steel Catenary Riser (SCRI) via the second vessel, such as a tug boat, across the sea bed to the third vessel (FSU), a simple installation method is achieved without the use of an expensive pipe lay vessel. The method provides increased flexibility in riser installation and hydrocarbon production and/or processing avoiding complex scheduling of the installation vessel and allowing riser installation at any suitable moment.

When pulling the pipe-string across the sea bed, the pulling angle relative to the vertical will be larger, in order to properly transmit the horizontal pulling force, than the required departure angle of the pipe-string form the third vessel or mooring buoy to which it is attached during use. By pulling the pipe-string further than the mooring point of the surface vessel or (submerged) buoy to which the termination end of the pipe-string is attached, the contact position of the pipe string with the sea bed is shifted towards the mooring position and the departure angle of the pipe-string is increased to the optimal value. As the pipe is not inspectable in this area the rules require the fatigue calculations to show a life of 10× the expected life of the pipe; i.e. for a 25 year field life the analysis must show a 250-year life. The designer will therefore take into account the vessel motions for 25 years and different angles of the pipe with soil parameters in the touchdown zone to determine what an acceptable angle is for the expected pipe motion. Generally a less vertical angle was found to increase the fatigue life. As less vertical angles result in larger loads on the vessel it is preferred to keep the angle as vertical as possible 15 to 20 degrees from vertical are preferred angles, however in deeper water the angles may be smaller.

The pipe string can be handed over from the second vessel to the FSU, at the side nearest the first vessel, so that the vessel can sail around the FUSU to pick up the pipe string at the side away from the first vessel. In that position the pipe-string can be pulled underneath the FSU past its mooring point, so that the pipe departure point from the sea bed is shifted sufficiently close to the FSU in order to obtain the desired departure angle. Next, the second vessel can return to the FSU to connect the termination end of the pipe-string. In this step the second vessel does not exert a very large pulling force, and can hence approach the FSU at a relatively close distance without the risk of collision in view of varying soil resistance as occurs during pulling of the pipe-string across the sea bed.

In an alternative method, the pipe-string is pulled past its mooring position by temporarily changing the mooring position of the third vessel. A first set of anchor lines facing the first vessel is slackened while a second set of anchor lines situated at a side facing away from the first vessel is tensioned, whereafter the firs set is tensioned and the second set is slackened.

In one embodiment, the first vessel comprises a drilling and/or work over vessel that is situated over an offshore hydrocarbon well. After or during drilling or work over activities on a hydrocarbon well, the pipe string can be towed to the third vessel and be connected at its termination end, whereafter its initiation end can be connected to the newly drilled well. In this manner multiple pipe strings or risers can be connected during the drilling of several wells, wherein the pipe-string installation process can occur simultaneously with the drilling operations.

In an embodiment of a riser installation method, according to the present invention, the pulling force exerted by the second vessel is intermittently increased and lowered to tow the transfer duct across the sea bed by a predetermined distance, followed by resting the transfer duct in a stationary state by repeating steps d and e. In case the pipe-string is made up of segments, which may be welded together or connected by threaded connectors, the intermittent pulling force can be synchronised with the pipe-assembly rate of the segments, and with the lowering cycle of the pipe-string. The distance by which the pipe-string is pulled in each cycle can correspond to the length of one or more segments, a segment having a length of for instance between 10 and 50 m. As the pipe length resting on the sea bed increases, the required pulling force will increase, which can be more effectively transferred in short spans of high power than as a continuous force.

In case of supplying the pipe-string from a spool or in case of using a dual drilling vessel which can lower two drill strings at one time and on which a continuous assemblage of pipe-segments can take place, a slow and continuous pulling force may be utilised to tow out the pipeline. A "dual drilling" vessel can perform drilling and separately a work-over activity at two wells at the same time or have two drill strings with different diameters for efficient drilling of one well. Such drilling vessels can have two drilling towers or a simple drilling tower were at the same time two drill strings can be assembled for efficiency purposes and to reduce the offshore drilling time (single or double derrick MODU). These dual drilling vessels are well known and used in the industry and for example described in U.S. Pat. No. 6,047,781 and U.S. Pat. No. 6,068,069, with title "Multi-activity offshore exploration and/or development drilling method and apparatus", which are both in the name of Transocean.

In order to accommodate for the bending of the transfer duct during installation, which assumes a catenary configuration, a guide member may be provided on the first vessel via which the transfer duct is guided along a curved path at an angle to the vertical from the first vessel in the direction of the sea bed. The guide member may for instance comprise a "stinger" that is placed near or below keel level of the first vessel, and comprising a number of bumpers of increasing diameter with distance below the rig. The series of bumpers forms a trumpet-like surface that has a radius (in the vertical plane) which limits the bend radius of the pipe-string and that keeps it from yielding when being pulled sideways to the angle required to deploy the pipe-string.

Adjustment of the take-off angle of the pipe-string or riser from the first vessel can also be effected by ballasting the first vessel to that its vertical centre line is tilted in the direction of the pipe-string. In this manner, no special provisions need to be taken for guiding the pipe string along a curved trajectory at the take-off point from the first vessel.

Some embodiments of a method according to the present invention will be explained in detail with reference to the accompanying figures:

DETAILED DESCRIPTION OF THE EMBODIMENTS

Figure 1:
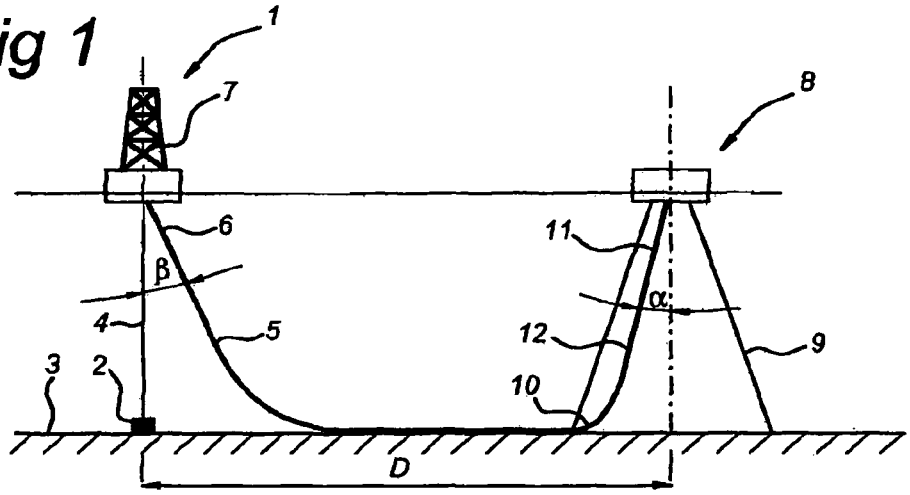
FIG. 1 shows a schematic representation of a drilling/work-over rig connected to a FPU via a steel pipe line supported on the sea bed.

FIG. 1 shows a drilling/work over rig 1 which is connected to a sub sea well 2 on the sea bed 3 via a drill string 4. A pipe line 5 is with an initiation end 6 connected to a lowering and lifting device 7 of the rig 1 extends at an angle of departure β to the vertical of between 3° and 10°. The pipe line 5 is supported on the sea bed and extends towards a FPU 8, which is moored to the sea bed via mooring lines 9 at a distance D of for instance between 500 m and 10 km. The pipe line 5 extends from a point of departure 10 on the sea bed, upwards to the FPU. The termination part 11 of the pipe line extends at an angle of departure a of between for instance 10° and 20°. The upper part 12 of the pipe line 5 may comprise a Steel Catenary Riser (SCR). The water depth may be between 500 m and 3000 m.

Installation of the pipe line 5 involves pulling the termination end 11 from the rig to the FPU 8 by way of a sub sea Pipe Line End Termination (PLET) or a Steel Catenary Riser (SCR) configuration near or directly to a Floating Production Unit (FPU) 8 which can be a FPSO, a Spar, a Semi-sub, a TLP, etc. The pipe line 5 is pulled across the sea bed 3 until the point of departure 10 is in the right position in order to obtain the desired angle of departure a. After installation, the initiation end 6 of the pipe line 5 may remain attached to the rig 1, or may be lowered, under ROV control, to be connected to hydrocarbon well 2. Once the pipe 5 is laid, the rig 1 can have the initiation end 6 of the pipeline 5 either attached to it or to the sub sea location 2.

During drilling or work over activities, the pipe line 5 or SCR can be assembled simultaneously at the drilling vessel 1 and be pulled out from the drilling vessel towards the FPU 8 with the help of a tugboat during stable weather conditions.

Drilling rig vessels 1 are normally used to drill or workover wells 2. After the well 2 is drilled or as explained above even during the drilling of the new well, the assembling of a new SCR or pipe line 5 can start and the tugboat can drag the pipe line into the right position. This procedure can be repeated while one pipeline is already installed and there is a hydrocarbon flow from one wellhead to the FPU. When a pipeline or SCR is disconnected from the drilling rig 1 and connected to the wellhead 2, hydrocarbon production and processing can start at the FPU 8. Additional pipelines can be installed from new wellheads drilled at the same place or the drilling rig vessel 1 can be moved to a different place and start drilling a new well.

Figure 2:
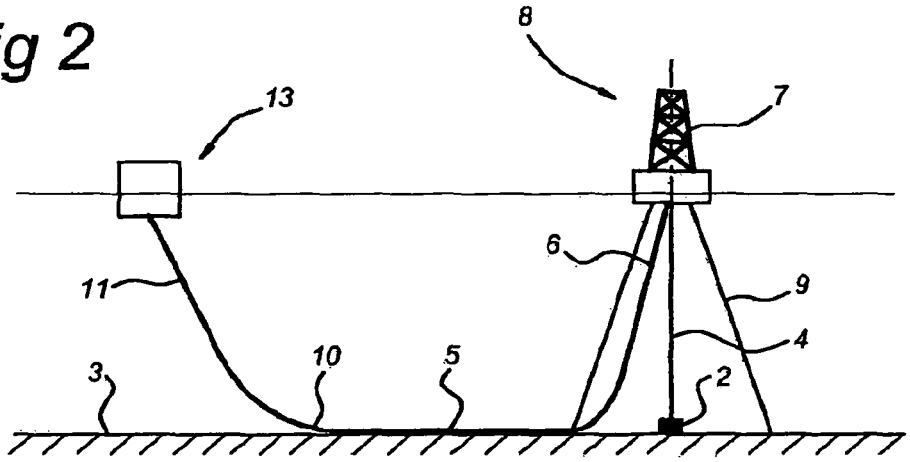
FIG. 2 shows a schematic representation of a FPU connected to a floating structure, such as an export terminal, via a pipe line supported on the sea bed.

In the embodiment of FIG. 2, the FPU 8 is connected to the initiation end 6 of the pipe line 5, and a third vessel, such as an export buoy 13, is attached to the termination end 11 of the pipe line 5. Upon installation, the termination end 11 is transferred from the FPU 8 to the vessel or buoy 13 via a tug.

Figure 3:
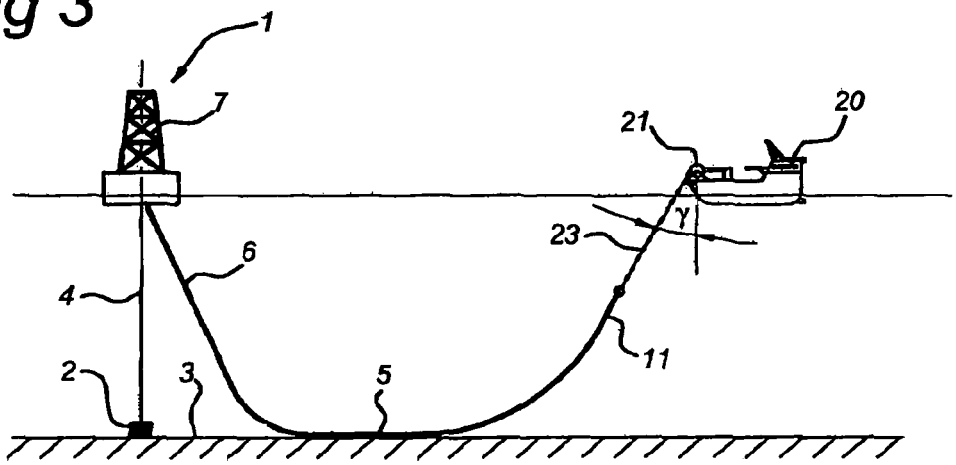
FIG. 3 schematically shows the departure angle of the pipe line at the tug during towing.

In FIG. 3, a tug 20 is shown towing the termination end 11 of pipe line 5 across the sea bed 3 from drilling/work over rig 1, to the FPU 8. The termination end 11 is attached to a cable or chain 23 which is attached to a winch 21 on the tug. The angle of departure γ with the vertical during towing is between 20° and 50 degrees in order to properly transfer a horizontal pulling force on the pipe line 5. The pipe line 5 may be made up of pipe segments which each may have a length of for instance 10-50 m and which are attached to the initiation end 6 by welding, but preferably by threaded connections. The lowering device 7 may be of the type that is described in WO 2004/035375 comprising a fixed and a movable clamp which alternately engage with the initiation end 6 for attaching pipe-segments of lowering of the pipe line 5.

Figure 4:
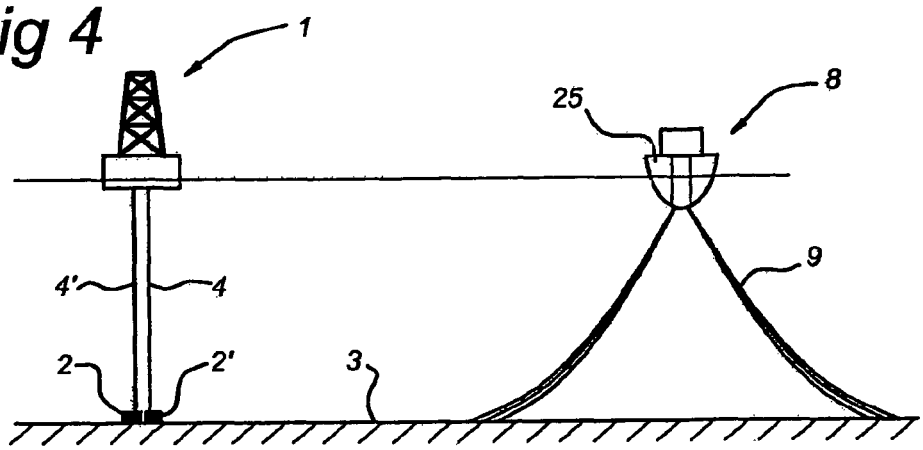
FIG. 4 schematically shows a layout of a dual drilling/work-over rig and a turret-moored FPU.

FIG. 4 shows a dual drilling vessel 1 with two drill strings 4,4', each extending to a respective sub sea well 2,2'. If there are no drilling activities at the dual drilling vessel 1, the dual drilling equipment aboard can be used for very efficient and quick assembling of the pipeline/SCR 5 as simultaneously two pipe segments for 1 pipeline or even two pipelines can be assembled at the same time. In this configuration a continuous assemblage of the pipeline 5 aboard the drilling vessel 1 is possible such that a slow, but continuous pullout of the pipeline 5 by the tugboat 20 could be done even without any stops.

Figure 5:
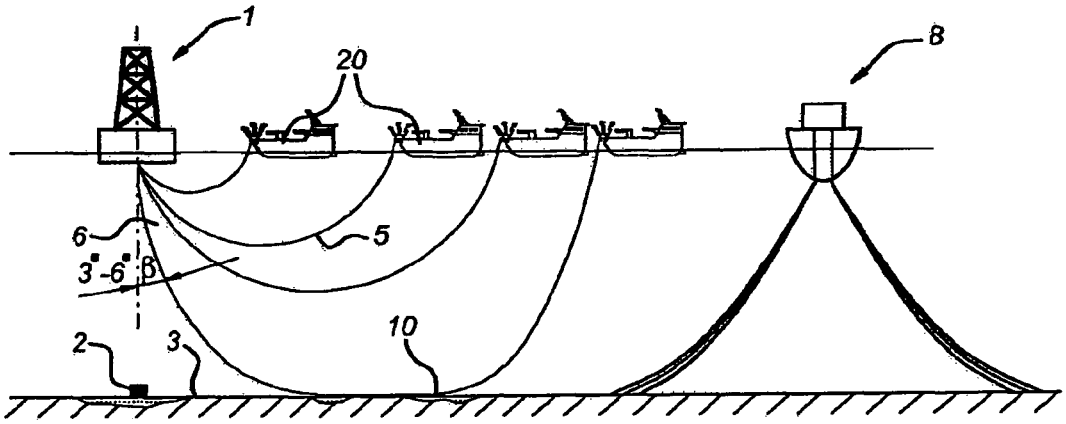
FIG. 5 shows a side view of a pipe line being towed from the drilling/work-over the rig of FIG. 4 to the FPU via a tug.
Figure 6:
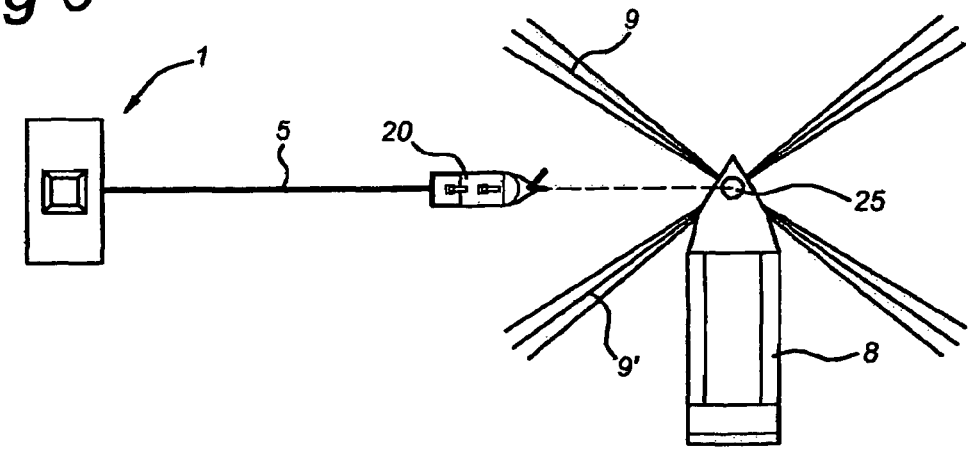
FIG. 6 shows a top view of the pipe line being towed from the drilling/work-over the rig of FIG. 4, as shown in FIG. 5.

As can be seen from FIG. 4, the FPU 8 and can comprise a turret 25, anchored to the sea bed 3, around which the vessel can weathervane depending on wind and current directions. As shown in FIG. 5, the tug 20 pulls out the pipe line 5 while the length increase by segments being attached to the initiation end 6. The tug 20 sails towards the FPU 8 such that it approaches the FPU 8 between the mooring lines 9, 9'.

A difficulty in the pipe pullout procedure when the pipeline 5 is dragged over the seabed 3 is the unknown soil friction on the pipe 5. As the pipe is sometimes stopped or sliding this pullout is uncertain as there is a static and dynamic soil friction. The static soil friction being larger than the dynamic friction means once the pipe slides the amount of sliding is dependent on the ratio of static to dynamic friction and the catenary configuration of the pipe and cable being used by the pulling tug. It is necessary to keep a safe distance when the tugboat 20 pulls towards the FPU 8 to account for the vessel motion toward the FPU when the pipe slides and also in the event the pulling cable should break. In case sliding of the pipe occurs, the vessel will move forward as the tension in the pulling cable drops.

Figure 7:
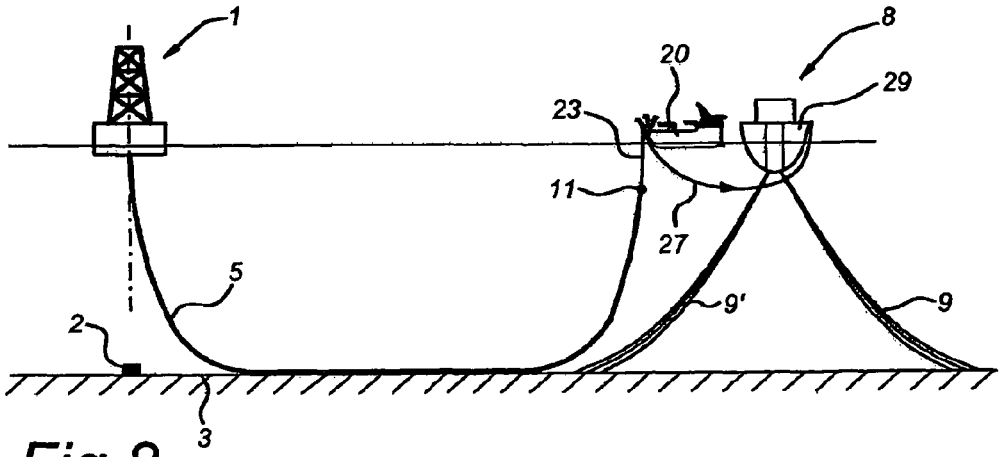
FIGS. 7-11 schematically show the pipe line being towed beyond the mooring position of the FPU, and then connect to the FPU.
Figure 8:
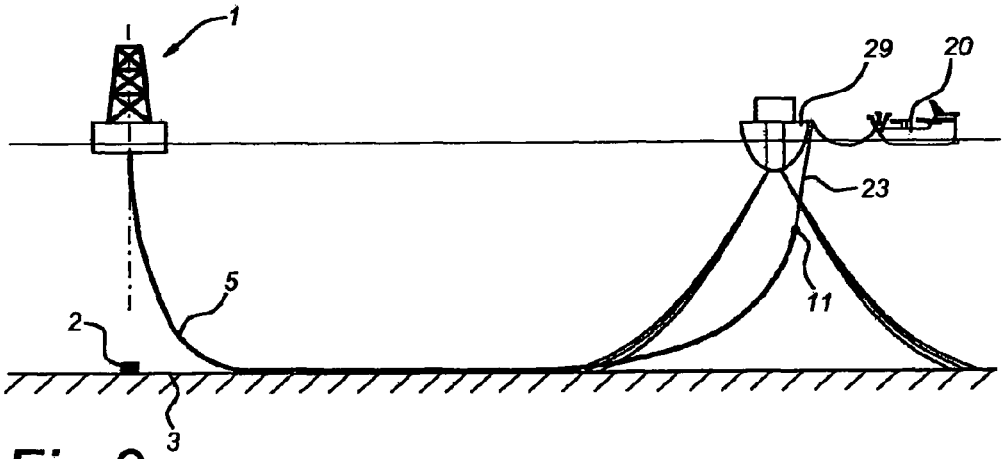
Figure 9:
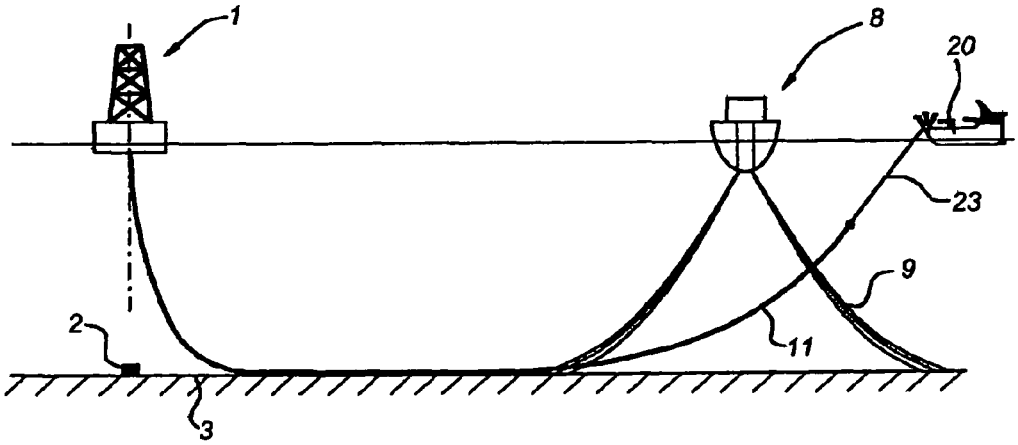

As can be seen in FIG. 7, the pipeline 5 is pulled up to the back of the tug and connected by way of a tri-plate to an installation line 27, extending from the FPU 8. The termination end 11 of the pipeline 5 is then lowered by the tug 20 until the FPU line 27 takes the pipe tension. The tug now releases itself from the pipe. The FPU line 27 is brought to the far side 29 of the FPU, as is shown in FIG. 8 where it is reattached to the tug 20, which has moved around the FPU. The attachment is made by way of the line 23 from the tug and a tri-plate. Once this line 23 is fixed to the tug 20, the pipe tension is again transferred to the tug, which can now pull the pipe 5 beyond the mooring position of the FPU 8, in order to place the take off point 10 at which the pipeline 5 leaves the sea bed 3, in the desired location, as shown in FIG. 9.

Figure 10:
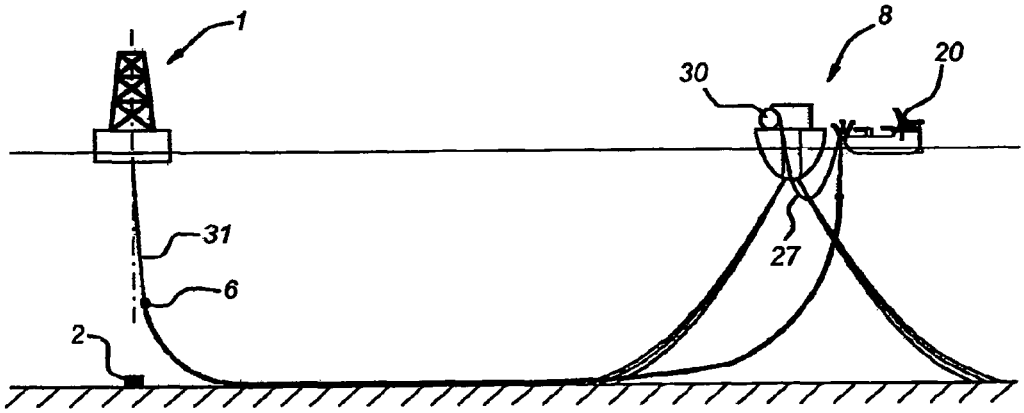
Figure 11:
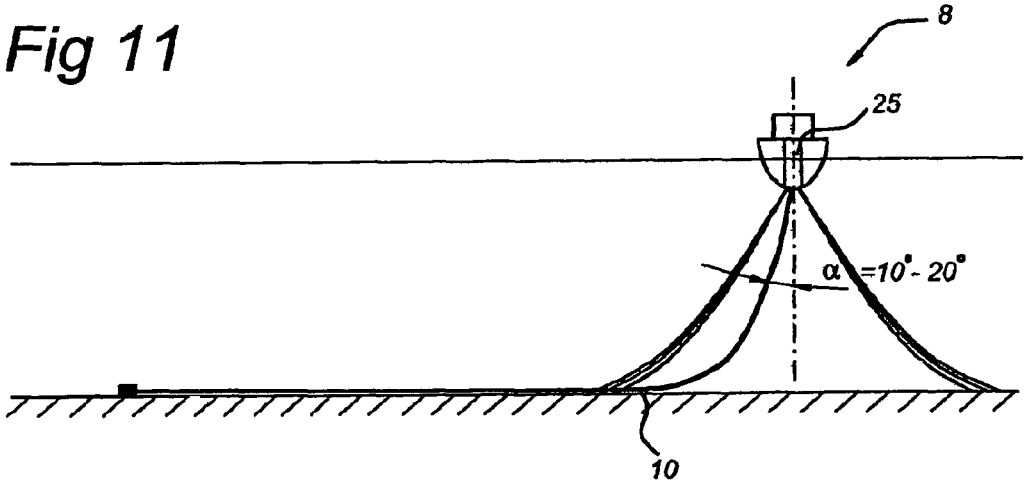

The installation line 27 is then transferred back to the FPU 8 and taken up on a winch 30, which then pulls the pipe 5 into its final configuration in which it is connected to the FPU, as shown in FIG. 11. Should the FPU be spread-moored, the pipe line 5 will be connected to the side, bottom or moon pool of the vessel. Should the FPU be turret moored the pipe will be attached to the turret 25. As shown in FIGS. 10 and 11, the initiation end 6 of the pipeline 5 is lowered from the drilling/work over rig 1 by a cable 31, to be attached to the hydrocarbon well 2.

Figure 12:
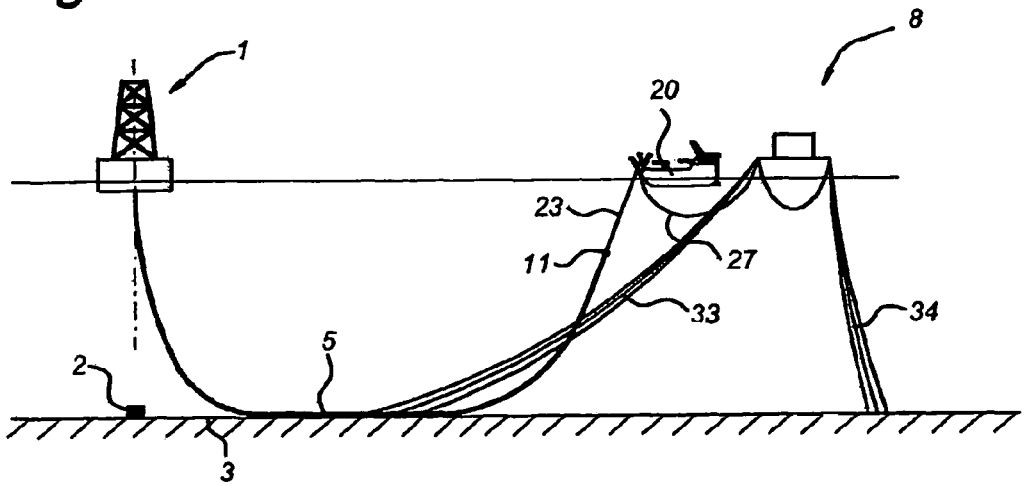
FIGS. 12-14 schematically show the pipe line being towed beyond the mooring position of the FPU via selective tightening and slackening of the FPU anchor lines.
Figure 13:
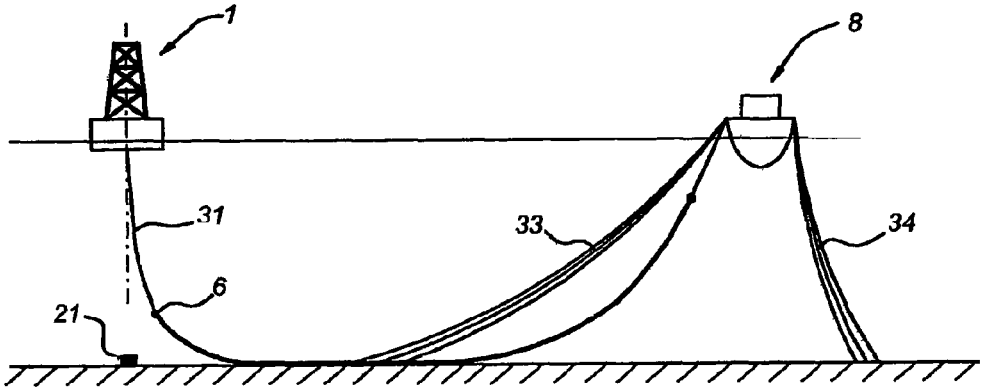
Figure 14:
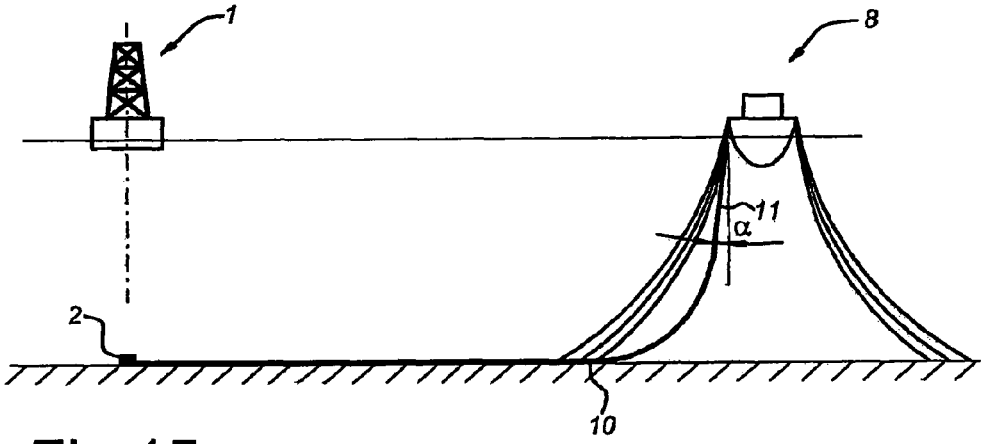

In the embodiment of FIG. 12, the FPU 8 is of a spread moored type, with mooring lines 33, 34. The mooring lines 33 are paid out, while the mooring lines 34 are tightened, such that the FPU is shifted away from its regular mooring position. The installation line 23 at the termination end 11 of the pipeline 5 is transferred to the FPU, which is then moved back to its equilibrium mooring position by tightening mooring lines 33 and slackening mooring lines 34, such as shown in FIG. 13. At the same time, the initiation end 6 of the pipeline 5 is lowered by a cable 31. As can be seen in FIG. 14, the mooring position of the FPU 8 is brought back to the equilibrium distance D, such that the point of departure 10 is situated close enough to the FPU and the angle of departure a of the termination end of the pipeline 5 is within the desired range.

Figure 15:
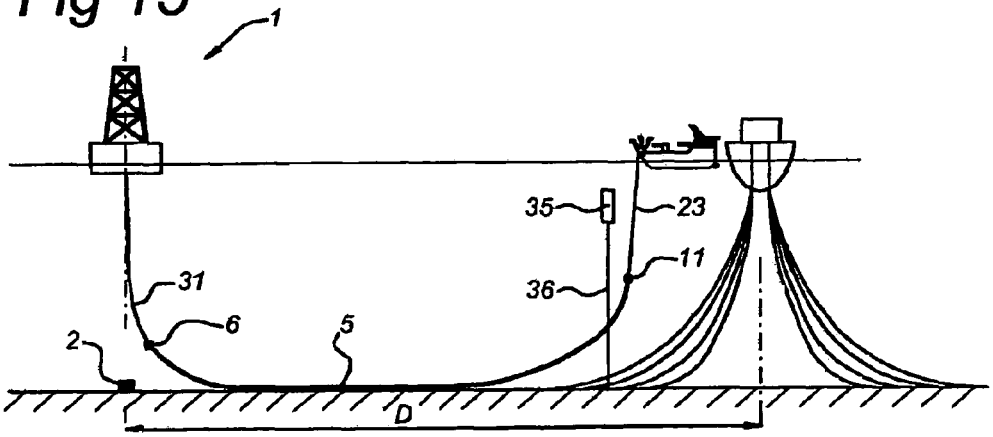
FIGS. 15 and 16 schematically show attachment of the termination end of the pipe string to a submerged buoy.
Figure 16:
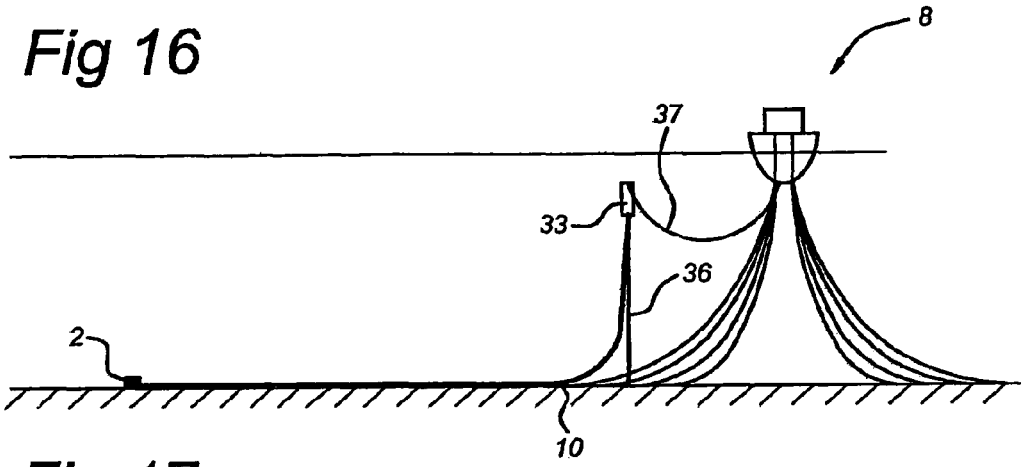

In the embodiment shown in FIGS. 15 and 16, the termination end 11 of the pipeline 5 is attached to a submerged buoy 35, which is anchored to the seabed 3 via a cable 36. The point of departure 10 is now situated close enough the buoy 35 to ensure that the angle α is again in the range of between 10° and 20°.

Figure 17:
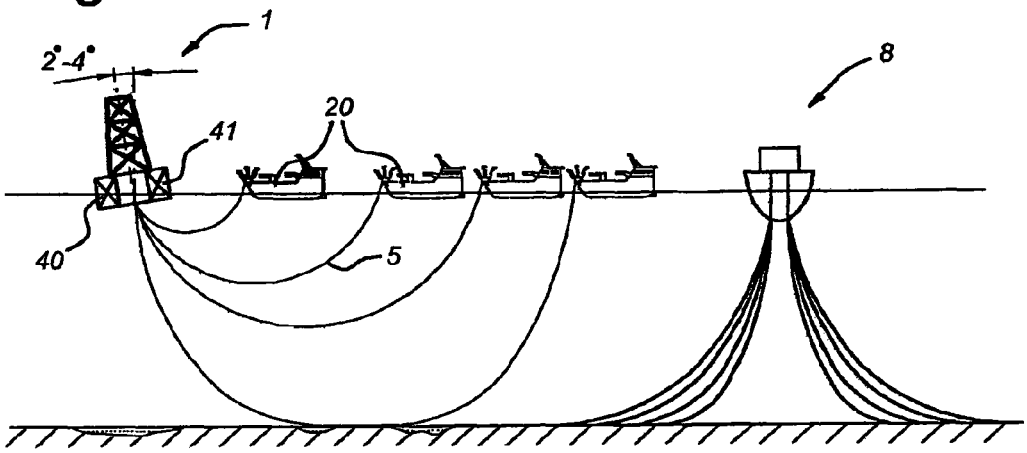
FIG. 17 schematically shows controlled tilting of the drilling/work-over rig to adapt the angle of departure of the rig to that of the catenary pipe string.

In FIG. 17 it is shown that the drilling/work-over rig 1 comprises ballast tanks 40, 41, which are filled with water to such extent that the vertical centerline 42 is tilted from the vertical by about 2°-4° in order to ensure that the departure angle β is between 3° and 6°.

Figure 18:
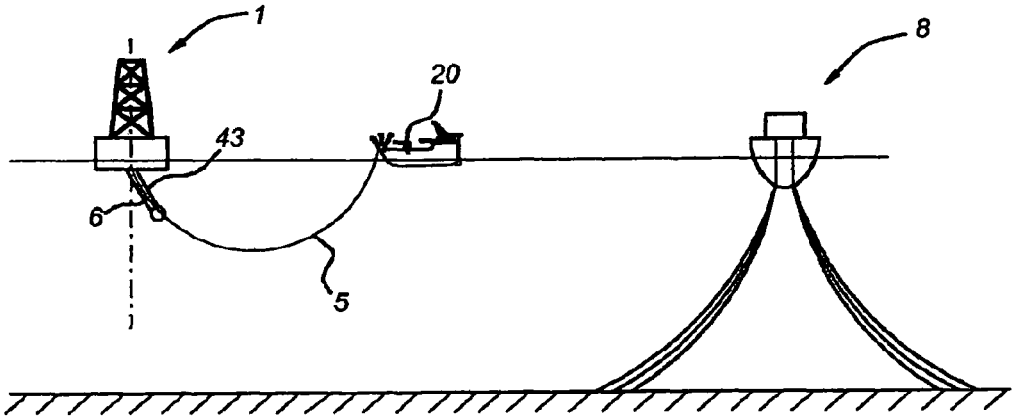
FIG. 18 schematically shows the use of a guide member for controlled bending of the pipe line.

In the embodiment of FIG. 18, a guide member 43 extends from the bottom of the rig 1. The guide member 43 may comprise pipe bend limiting rollers (referred to as a stinger on a pipe lay-vessel) to keep the pipe from over-bending due to this static and some additional wave induced dynamic angles. The stinger has a series of concentric circular bumpers that increase in diameter with distance below the rig. This series of bumpers effectively forms a trumpet Like surface that has a radius (in the vertical plane) which limits the pipeline bend to one that keeps it from yielding when being pulled sideways to the angle required to deploy the pipeline. The combination of a slight trim and stinger at the drilling vessel 1 is also possible.

The invention claimed is:

1. A riser installation method, comprising the steps of:

providing a first vessel situated over a hydrocarbon well;

supporting a hydrocarbon transfer duct from the first vessel by a first end that is attached to a lowering device on the first vessel;

attaching a second end of the hydrocarbon duct to a second vessel, at a position near the first vessel;

lowering the transfer duct via the lowering device;

increasing the distance of the second vessel from the first vessel by sailing the second vessel in the direction of a third vessel, which is moored in a mooring position at a distance from the first vessel, while pulling the transfer duct until the second vessel is near the third vessel;

contacting a section of the transfer duct with the sea bed at a position between the first and second ends of the transfer duct;

displacing a second end of the transfer duct over a distance from the first vessel, seen in the length direction of the transfer duct, which is larger than the distance between the first vessel and the mooring position of the third vessel;

returning the second end of the transfer duct to mooring position of the third vessel; and bringing the second end of the hydrocarbon transfer duct in fluid communication with the third vessel.

2. The riser installation method according to claim 1, wherein the second end of the hydrocarbon transfer duct is transferred from the second vessel to the third vessel when the second vessel is positioned between the first and the third vessel, whereafter the second vessel sails to a side of the third vessel that is situated away from the first vessel, whereafter the second end of the transfer duct is transferred to the second vessel which sails away from the first vessel by a predetermined distance and is then returned to the third vessel, whereafter the second end of the transfer duct is transferred to the third vessel or to a buoy.

3. The riser installation method according to claim 1, wherein after attaching the transfer duct to the third vessel, the third vessel is moved away from the first vessel in the length direction of the transfer duct, from a mooring position, and back to the mooring position.

4. The riser installation method according to claim 3, wherein a first set of anchor lines facing the first vessel is slackened while a second set of anchor lines situated at a side facing away from the first vessel is tensioned, whereafter the first set of anchor lines is tensioned and the second set of anchor lines is slackened.

5. The riser installation method according to claim 1, wherein the first vessel further comprises a drilling and/or work over vessel that is situated over an offshore hydrocarbon well.

6. The riser installation method according to claim 1, wherein the step of pulling the transfer duct is accomplished by applying a pulling force that is intermittently increased and lowered to tow the transfer duct across the sea bed by a predetermined distance, followed by resting the transfer duct in a stationary state.

7. The riser installation method according to claim 1, wherein the transfer duct comprises segments, and wherein the step of lowering the transfer duct via the lowering device is preceded by attaching a transfer duct segment to the first end of the hydrocarbon transfer duct.

8. The riser installation method according to claim 7, wherein the predetermined distance corresponds to a length of one or more transfer duct segments.

9. The riser installation method according to claim 7, wherein the transfer duct segment is interconnected to a second transfer duct segment using mechanical couplers.

10. The riser installation method according to claim 7, wherein the segments are interconnected by welding.

11. The riser installation method according to claim 1, wherein the first vessel is provided with a guide member via which the transfer duct is guided along a curved path at an angle to the vertical from the first vessel in a direction of the sea bed.

12. The riser installation method according to claim 1, wherein the first vessel further comprises at least one ballast tank, which is ballasted on one side of the vessel to incline a vertical centre line of the vessel in the direction of the hydrocarbon transfer duct.

13. The riser installation method according to claim 1, further comprising at least one drilling rig provided on the first vessel, the drilling rig adapted to extend two drill strings from the first vessel to a sub sea hydrocarbon well.

14. The riser installation method according to claim 13, wherein one drill string is connected to the hydrocarbon well, while the transfer duct is being installed.

15. The riser installation method according to claim 1, wherein a portion of a riser is attached to a submerged buoy, and a flexible hose is connected to the third vessel.

16. The riser installation method according to claim 6, further comprising subsequently performing the steps of:

lowering the transfer duct via the lowering device; and increasing the distance of the second vessel from the first vessel by sailing the second vessel in the direction of the third vessel, which is moored in a mooring position at a distance from the first vessel, while pulling the transfer duct until the second vessel is near the third vessel.

17. The riser installation method of claim 9, wherein the transfer duct segment is interconnected to a second transfer duct segment by threaded couplers.

* * * * *